US005899384A

United States Patent [19]

Solbakke

[11] Patent Number: 5,899,384

[45] Date of Patent: May 4, 1999

[54] NOZZLE WITH JET HOLE FOR CLEANING

[75] Inventor: Hans Terje Solbakke, Lunde, Norway

[73] Assignee: Bandak A/S, Lunde, Norway

[21] Appl. No.: 08/860,603

[22] PCT Filed: Nov. 22, 1995

[86] PCT No.: PCT/NO95/00215

§ 371 Date: Jul. 1, 1997

§ 102(e) Date: Jul. 1, 1997

[87] PCT Pub. No.: WO96/20791

PCT Pub. Date: Jul. 11, 1996

[30] Foreign Application Priority Data

Jan. 5, 1995 [NO] Norway ..... 950045

[51] Int. Cl.[6] ..... B05B 15/02; B05B 1/32

[52] U.S. Cl. ..... 239/119; 239/436; 239/538; 239/587.1

[58] Field of Search ..... 239/119, 435, 239/436, 538, 393, 590, 447, 587.1

[56] References Cited

U.S. PATENT DOCUMENTS

| | | | |
|---|---|---|---|
| 3,116,882 | 1/1964 | Vork | 239/119 |
| 3,528,611 | 9/1970 | Watson | 239/119 |
| 4,508,268 | 4/1985 | Geberth | 239/119 |
| 5,154,351 | 10/1992 | Takko | 239/110 |
| 5,715,975 | 2/1998 | Stern et al. | 239/393 X |

FOREIGN PATENT DOCUMENTS

| | | |
|---|---|---|
| 0 255 463 | 2/1988 | European Pat. Off. . |
| 90/15184 | 12/1990 | WIPO . |

*Primary Examiner*—Andres Kashnikow
*Assistant Examiner*—Sean P. O'Hanlon
*Attorney, Agent, or Firm*—Browdy & Neimark

[57] ABSTRACT

A nozzle, preferably a nozzle for a spray pipe, designed and arranged for cleaning whilst in operation, comprising a nozzle body (2), in which there is disposed a tightly fitting turnable body (1) having an orifice (9) for shaping a fluid jet and wherein on the nozzle body there are provided structure (2) for securing the nozzle to a supply pipe (4), preferably a spray pipe, characterised in that hole (10), having a diameter approximately equal to that of the supply pipe (4) is bored partly through the turnable body (1), that jet shaping orifice (9), having a smaller opening than the hole (10), is formed as an extension thereof through the turnable body (1) and that jet pod (11), having a diameter approximately equal to the diameter of the supply pipe (4), is bored through the turnable body (1) approximately perpendicular to the first hole (10) and intersects it.

6 Claims, 6 Drawing Sheets

NOZZLE WITH JET HOLE FOR CLEANING

FIELD OF THE INVENTION

The present invention relates to a nozzle, preferably a nozzle for spray pipes, or to be more precise an improved nozzle for cleaning both supply pipes and the nozzle of impurities without cutting off the flow of fluid or using any form of external cleaning equipment.

The nozzle is especially designed for placing on a spray pipe in the processing industry, where it is important that the machinery is not brought to a standstill because of the cleaning of impurities from nozzles, but may also have other applications.

REVIEW OF RELATED TECHNOLOGY

The purpose of spray nozzles is to shape the fluid fed from a spray pipe into a desired jet and direct this toward the equipment which is to be cleaned or hosed down. As spraying fluid it is common to use spraying liquids which are not entirely free of impurities, such as metal particles, plastic particles, fibres of various kinds and so forth. Impurities of this kind can cause the nozzles to become blocked, and therefore expensive equipment for purifying the spraying liquid, such as spraying liquid filters, arc strainers, cleanable trunk pipes and so forth, is usually mounted in front of the nozzle.

Often, to save installation costs, cleaning equipment is not installed in front of the nozzles, and this results in the equipment having to be frequently dismantled and cleaned, which in turn may result in a shutdown of the machinery.

The reason that the nozzles become bunged up is that particles or aggregations of particles which are larger than the outlet orifice of the nozzle reach the outlet orifice. The impurities which come to a stop in the outlet orifice will then trap particles of various sizes and form a bung. This bung is not entirely liquid-tight and liquid can drain therethrough, whilst particles of various sizes are held back allowing the bung to grow inward in the pipe until the pipe gradually becomes completely blocked so that ultimately no more liquid passes through the pipe and the nozzle.

When using the most common spray nozzle types, cleaning takes place in that the fluid supply to the nozzle is cut off whereupon the nozzle is dismantled and cleaned manually of impurities. The fluid supply in the spray pipe is then turned on so that the bung which has built up in the spray pipe is flushed out. The liquid supply is then cut off again and the nozzle remounted, whereupon the liquid supply can be turned back on and the nozzle put into use again.

A procedure of this kind inevitably results in major interruptions of production in the machine/process for which the nozzles in question are installed, and in addition involves time-consuming and expensive maintenance of the machine/process.

Swedish Patent 463772 makes known a nozzle on a spray pipe for cleaning both the spray pipe and the nozzle, wherein there is disposed in the nozzle a turnable body through which there is a conical hole for forming spray jets, and also an external channel which permits the spraying liquid to be directed around the conical hole in order to flush the spray pipe.

During normal operations the turnable body is in a position such that the spraying liquid is conducted through the conical hole from the largest opening of the hole toward the smaller opening. When the spray pipe is to be cleaned, the turnable body is turned so that the spray jet is directed around the conical hole through the recess and out through an opening on the side of the nozzle. The conical hole can then be cleaned by turning the turnable body so that the spraying liquid is conducted through the conical hole in the reverse direction, so that accumulated impurities are flushed out. The turnable body is then turned back to the operative position, and the nozzle is once again ready for operation.

The advantage of this nozzle over the known fixed nozzles is that the spray pipe and the nozzle can be cleaned speedily without stopping the process—or only with a brief interruption thereof—without the spraying liquid pressure having to be cut off.

However, the nozzle according to Swedish Patent 463772 is encumbered with some drawbacks. Firstly, a nozzle having a conical hole gives a low pressure drop in the spraying liquid. This results in the need to use nozzles having a relatively small diameter in order to restrict the consumption of the spraying liquid. A small diameter of this kind creates a great risk of the nozzle becoming bunged up as the amount of particles which have a diameter sufficiently large to become stuck in the hole increases considerably. Most often, to reduce the problems of bunging the choice is made to increase the diameter of the opening, which in turn results in a relatively high consumption of spraying liquid.

When cleaning the spray pipe, the spraying liquid is directed, as mentioned above, through a channel provided on the outside, which means that the impurities pass around the turnable body or through a curved side channel. A complete flushing out of all the impurities requires a straight hole having a passage diameter approximately equal to the diameter of the spray pipe. A deflection of the cleaning channel as taught in SE 463772 therefore prevents a complete flushing out of the impurities so that in certain cases the nozzle must nevertheless be dismantled, in addition to the fact that the remaining impurities in the spray pipe cause a rapid bunging up of the nozzle and pipe.

Thirdly, it is relatively expensive to vary the hole size of the nozzle bore of the nozzle according to Swedish Patent 463772. The spray jet must in fact hit the spray shaping member at the right point in order not to produce an incorrect spray shape. A special nozzle body is thus required for each size of the nozzle bore.

SUMMARY OF THE INVENTION

Thus, the object of the present invention is to provide a nozzle—especially a nozzle for spray pipes—which permits the cleaning of both the spray pipe and the nozzle itself, where the drawbacks of the nozzle known from Swedish Patent 463772 are avoided.

According to the present invention, this is done by means of a nozzle, preferably a nozzle for a spray pipe, designed and arranged for cleaning whilst in operation, comprising a nozzle body, in which there is placed a tightly fitting turnable body having an orifice for shaping fluid jets, and where on the nozzle body there are means for securing the nozzle to a supply pipe, preferably a spray pipe, which is characterised in that holes having a diameter approximately equal to the diameter of the supply pipe are bored partly through the turnable body, that a jet shaping orifice having a smaller opening than the hole is bored as an extension thereof through the turnable body, and also that a jet pod having a diameter approximately equal to the diameter of the supply pipe is bored through the turnable body approximately perpendicular to the first hole and intersects it.

BRIEF DESCRIPTION OF THE DRAWING FIGURES

The invention will now be described in more detail with reference to the attached figures, wherein.

Figure 6:
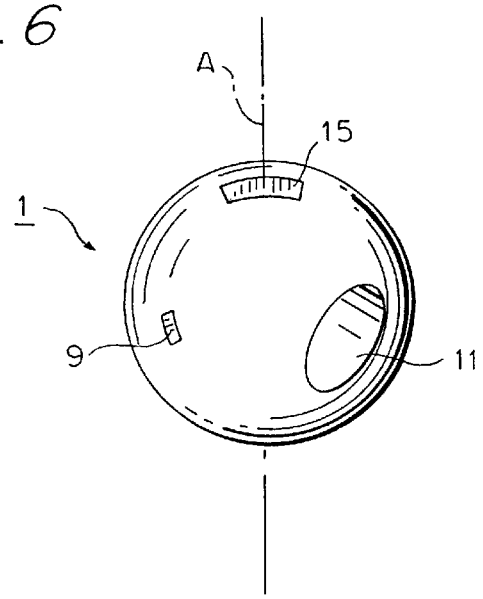
FIG. 6 is a perspective view of a spherical turnable body (ball).

The nozzle illustrated in FIGS. 1 to 4 consists of a nozzle body or housing 2, which is connected to a supply pipe, in this case a spray pipe 4, via an intermediary 12. The turnable body which in the illustrated embodiment is a ball, is mounted between gaskets 3 and can be turned about an axis A through the centre of the ball, perpendicular in sections 1 to 3, by turning handle 5, thereby turning spindle or shaft 6. The axis A is shown in FIG. 6. The nozzle is screwed into spray pipe 4 by means of intermediary means for the nozzle to the supply pipe 12 which on the illustrated nozzle is also screwed into nozzle body 2 and constitutes the upper part of the nozzle body 2.

Hole 11, having a diameter approximately equal to the diameter of the supply pipe, is bored through the diameter of the ball. Hole 10 which is preferably of the same diameter as hole 11, is bored at right angles to hole 11, but this hole does not extend right through the ball. Jet shaping orifice 9, which is smaller in diameter than the holes 10 and 11, forms a direct continuation of hole 10. The hole 11 is also referred to herein as a jet hole or jet pod.

Gaskets 3 are located between the ball 1 and the nozzle body 2. They secure the ball and also ensure that fluid does not flow around the ball, but only therethrough.

In a spraying position, the turnable body 1 is positioned such that hole 10 forms a natural extension of the interior cavity of the spray pipe 4. The spraying liquid then flows from the spray pipe 4 through hole 10 to jet shaping orifice 9 and out therethrough. In this position, hole 11 in the turnable body 1 is approximately perpendicular to the direction of flow of the spraying liquid so that no fluid flows therethrough.

The fluid from jet shaping orifice 9 flows out of the nozzle through orifice 14 in the nozzle body 2 toward spray shaping body 7 which deflects and shapes the jet according to need. The orifice 14 in the nozzle body 2 has a diameter which is at least as great as the diameter of hole 11.

Jet shaping orifice 9 is preferably approximately cylindrical and not conical as is usual. Since the pressure drop across a cylindrical hole, especially at the transition from a cylindrical hole to one of smaller diameter, is greater than the pressure drop across a conical hole having the same opening diameter, the consumption of spraying liquid will be smaller than with the same opening diameter of a cylindrical jet shaping orifice 9 than with a conical hole. The smaller the opening diameter of the jet shaping orifice 9, the greater the risk of blockage in the hole.

Figure 1:
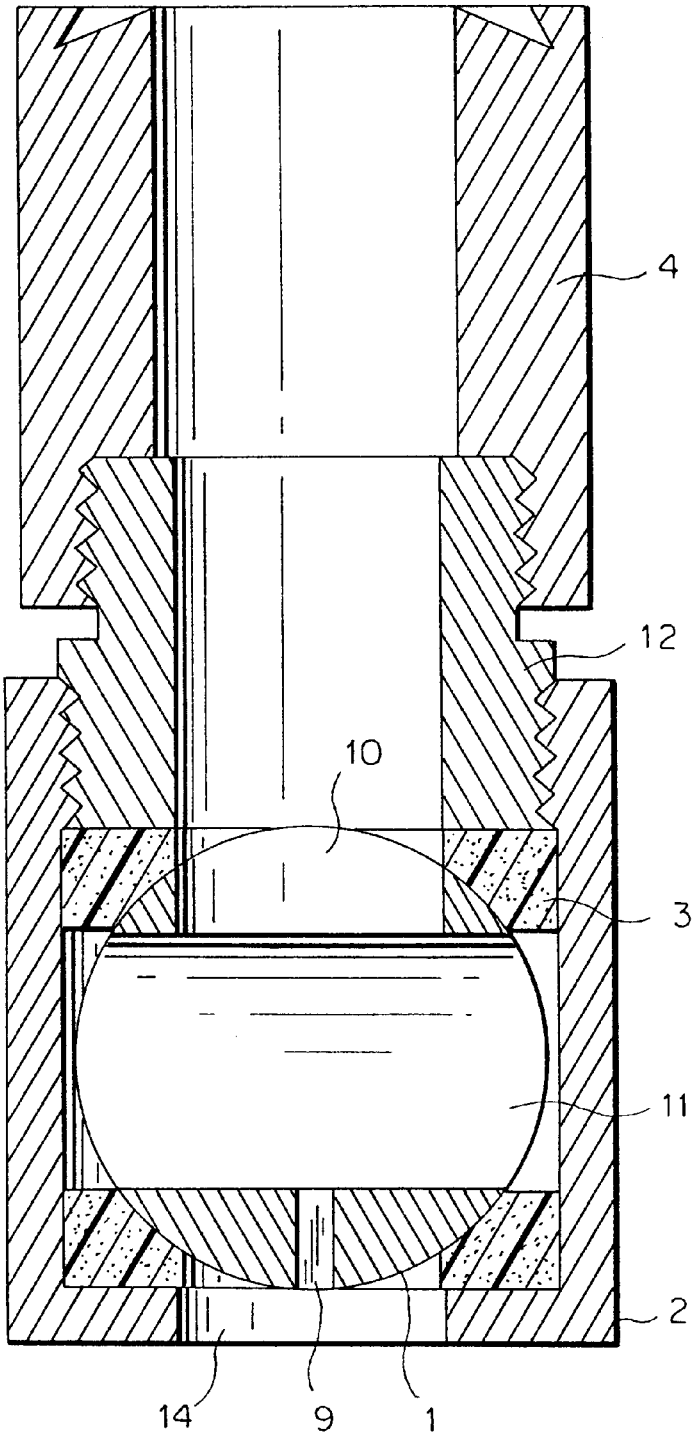
FIG. 1 is a longitudinal section through part of a supply pipe and a spray nozzle according to the present invention, with the nozzle in the spraying position.
Figure 2:
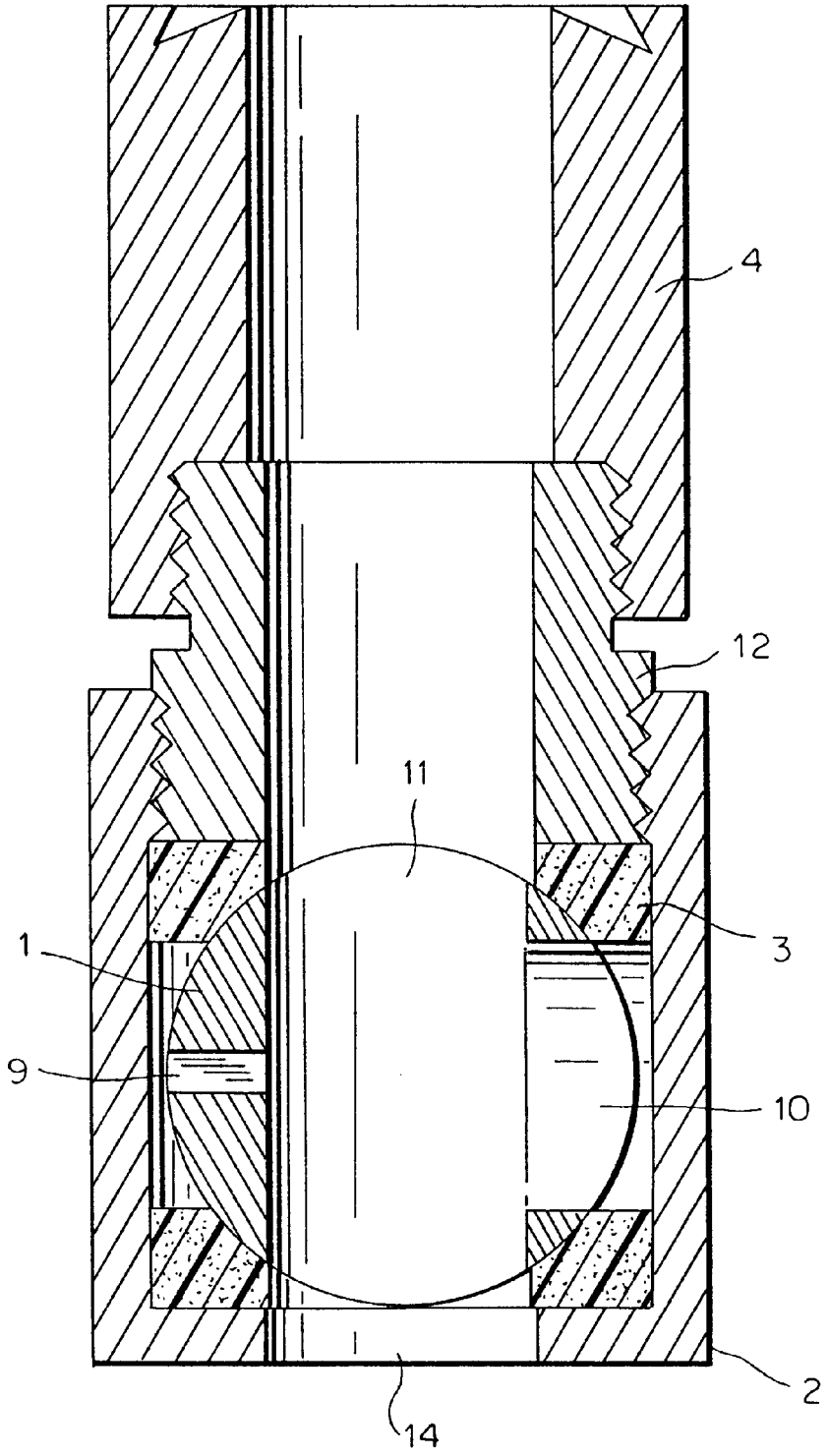
FIGS. 2 and 3 are sections corresponding to that in FIG. 1, but where the nozzle is in different cleaning positions.
Figure 3:
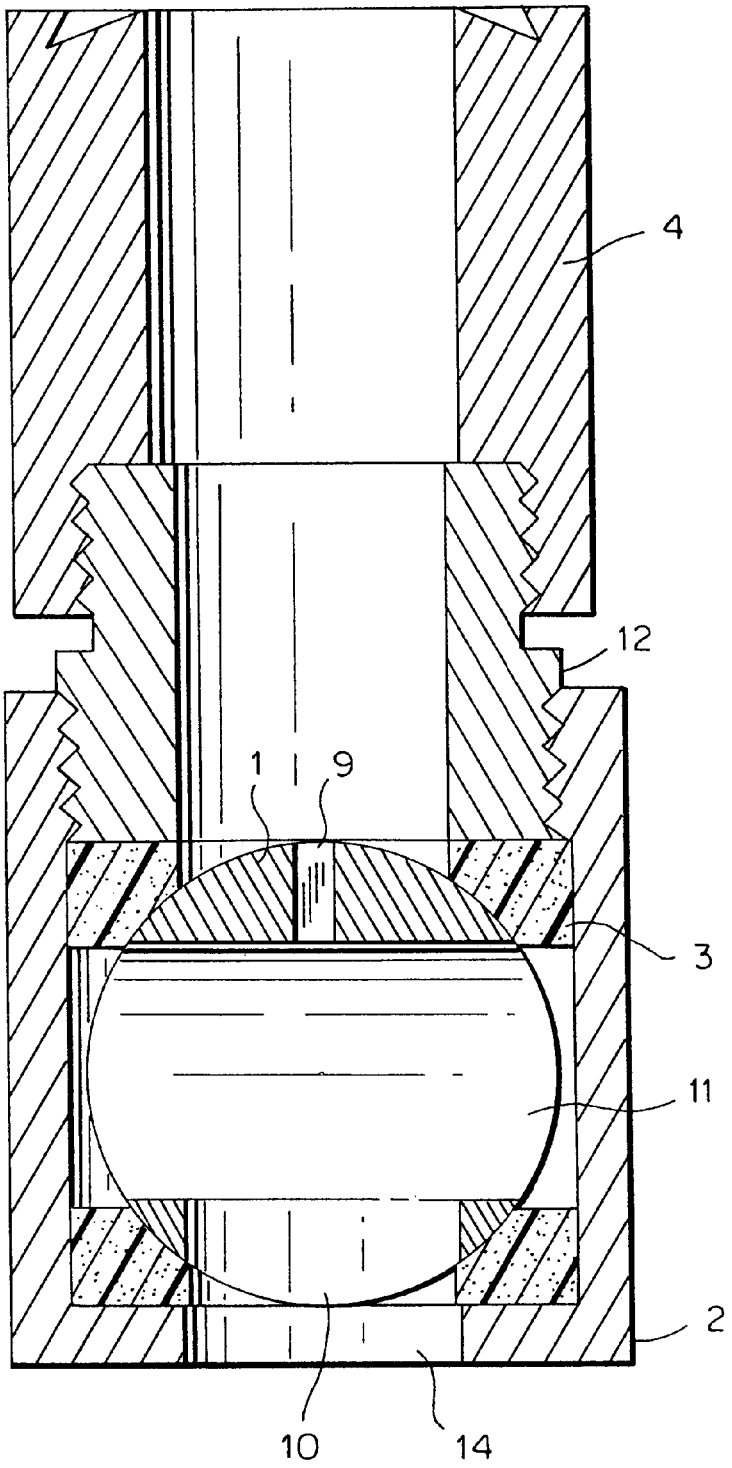

When first the jet shaping orifice and then the spray pipe are blocked by particles, the pipe is the first to be cleaned by rotating the rotatable body 1 as shown in FIG. 2. As hole 11 provides a straight extension of spray pipe 4, and also as the diameter of the hole is approximately equal to the internal diameter of the spray pipe 4 and intermediary 12, the pipe in this case will be efficiently cleaned and all impurities flushed out. In order to remove particles which block jet shaping orifice 9, the rotatable body 1 is rotated as shown in FIG. 3 to reverse the direction of the spraying liquid through the hole so that the bung is flushed out. Lastly, the rotatable body is rotated back as shown in FIG. 1 and the nozzle is once more in normal operation.

The handle 5 is attached to spindle 6 by means of nut 13. Gaskets 8 seal against potential leakage along spindle 6. Spindle 6 is attached to the rotatable body 1 in groove 15.

Spray shaping body 7 is either an extension of housing 2 or is attached to housing 2. Jet shaping orifice 9 is positioned in the rotatable body 1 so that the jet hits the proximate part of the spray shaping body 7 approximately tangentially. The jet then follows the deflection of the spray shaping body 7 and is shaped as required for the use in question.

It is essential that the jet from jet shaping orifice 9 hits spray shaping body 7 in the correct manner to provide the appropriate spray jet. In conventional conical jet shaping orifices, it has been necessary to change spray shaping body 7 by altering the diameter of the opening of the jet shaping orifice. With the present nozzle such a change of spray shaping body 7 is not necessary. The essential is that jet shaping orifice 9 is positioned in the rotatable body 1 in such a way that the jet hits the proximate part of the spray shaping body 7 approximately tangentially. This is accomplished by displacing the centre line in the spray shaping body parallel to the diameter of the ball so that the jet hits the spray shaping body 7 tangentially. This adjustment allows the diameter of the jet shaping orifice to be changed, if so desired, simply by replacing the rotatable body 1 by unscrewing the intermediary 12 from the housing 2, loosening spindle 6, replacing the rotatable body 1 with a new one having a jet shaping orifice 9 of the desired diameter and then reassembling the nozzle.

Figure 4:
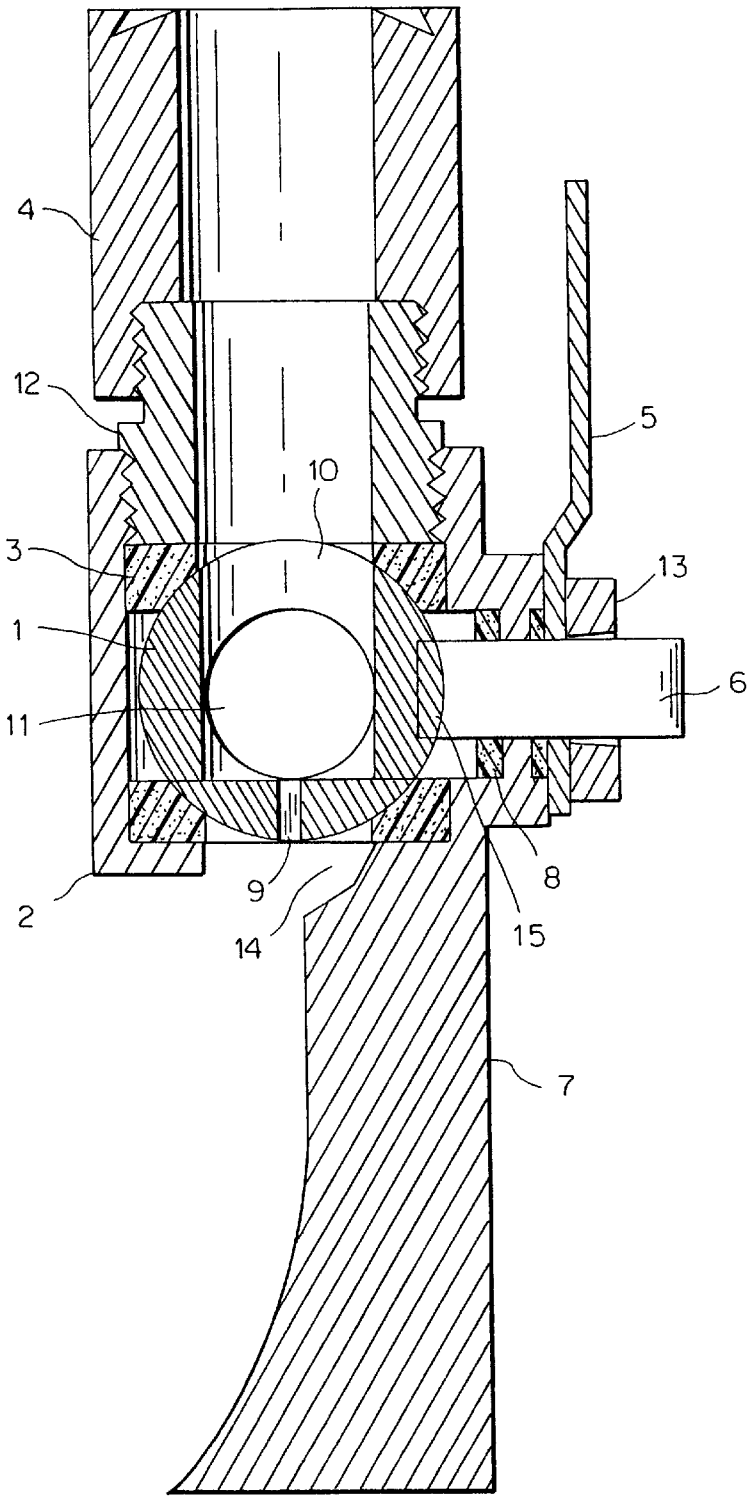
FIG. 4 is a longitudinal section of the embodiment shown in FIGS. 1–3, 90° to the section illustrated therein.
Figure 5:
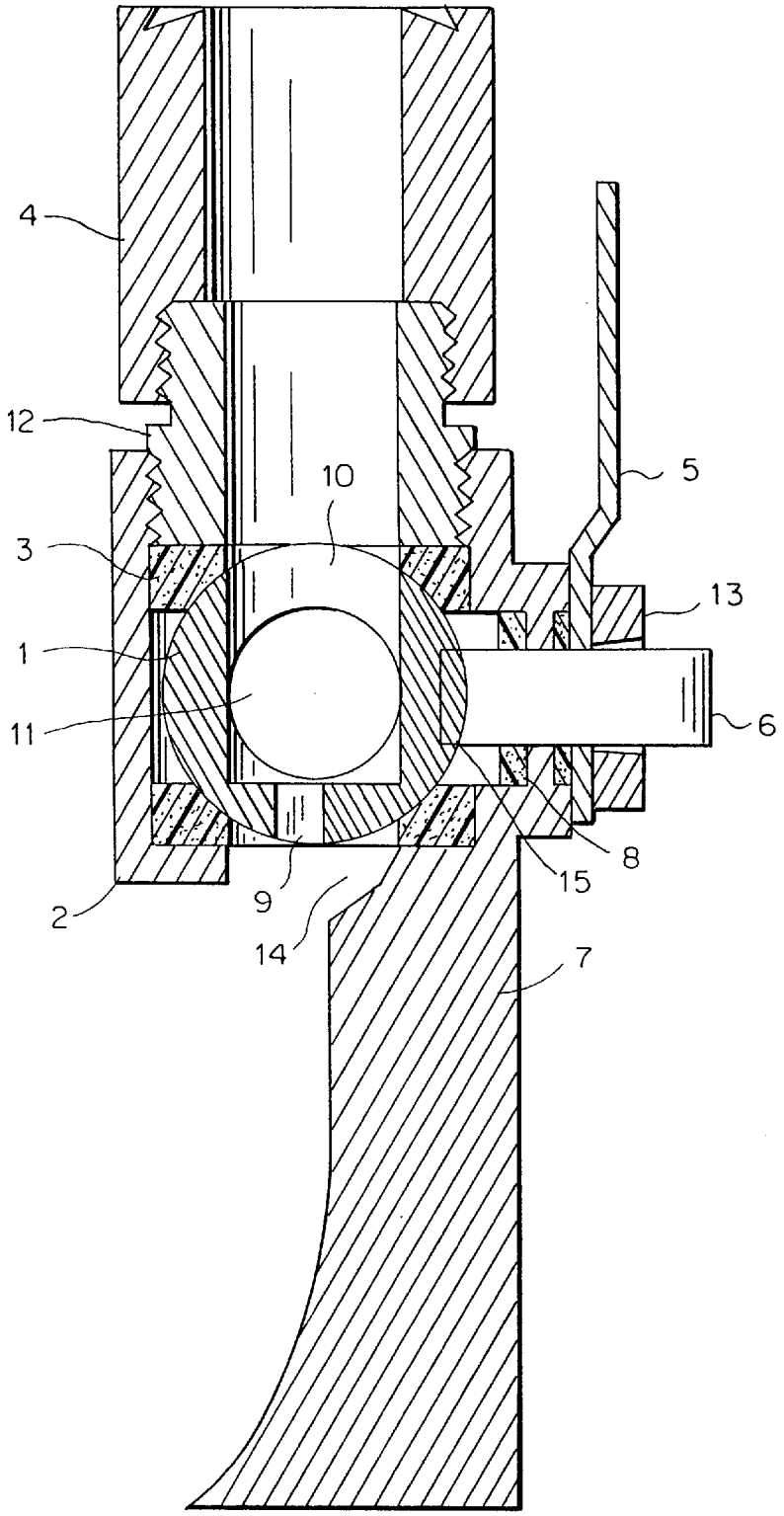
FIG. 5 shows the same cross-section as FIG. 4, with the jet shaping orifice having a larger diameter.

FIG. 5 illustrates a nozzle according to the invention having a larger jet shaping orifice 9 than that shown in FIG. 4. In particular, it can be seen that the centre line of the jet shaping orifice has been displaced relative to that shown in FIG. 4 so that the jet will hit the spray shaping body 7 tangentially.

Nozzles for different use and where there is a need for nozzles having a jet shaping orifice 9 of different diameter can thus be produced economically and rationally as the only thing which must be varied from nozzle to nozzle is the diameter and position of jet shaping orifice 9 in the rotatable body 1. The various parts of the nozzle can therefore be produced in great numbers whilst the turnable body can be prefabricated with holes 10 and 11 only. Jet shaping orifice 9 can then be bored open when it has been decided what the diameter of the jet shaping orifice should be for the use in question. If changes take place in the process where the nozzle is used, changes of the characterising features of the nozzle can be made simply by replacing the rotatable body 1 and not the entire nozzle.

Figure 7:
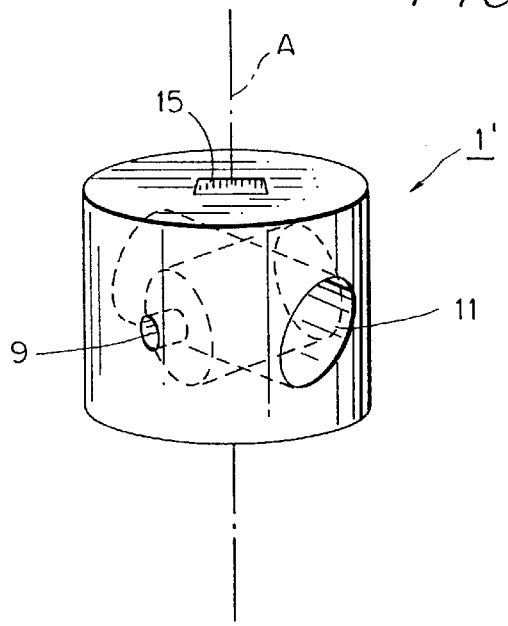
FIG. 7 is a perspective view of a cylindrical turnable body.

In the illustrated embodiment the rotatable body is a ball. However, in other embodiments the rotatable body may be approximately cylindrical with an axis of rotation A coinciding with the axis of rotation A of spindle 6. A cylindrical rotatable body 1' is depicted in FIG. 7. FIG. 7 shows by dashed lines that the jet hole 11 internally intersects the spray-supply hole 10.

The nozzle may also be attached in other ways than being screwed into the spray pipe 4 as shown in the figures. For example, the intermediary 12 can be omitted and the spray pipe 4 can be threaded externally so that it can be screwed into the nozzle body 2.

The nozzle according to the invention can, of course, also be used for spraying various fluids within other areas where a single and rapid cleaning of the nozzle without cutting off the flow of fluid is important. In the case of some uses, it may be preferable for jet shaping orifice 9 to be of a different design than the shape described above. Jet shaping orifice 9 may, for example, be slot-shaped for uses where a broader jet without the use of jet shaping body 7 is required. FIG. 6 illustrates a slot-shaped shaping orifice 9.

What is claimed is:

1. A nozzle securable to a supply pipe having a diameter, the nozzle being self-cleanable in operation, and comprising:

a nozzle body (2) including means (12) for securing the nozzle to the supply pipe (4), wherein the nozzle body includes a tightly fitting turnable body (1) wherein a radially disposed spray-supply hole (10), having a first diameter approximately equal to the diameter of the supply pipe (4), extends partly through the tunable body (1), and wherein a jet shaping orifice (9) having an opening smaller than the spray-supply hole (10), for shaping a fluid jet, comprises an extension of spray-supply hole (10) through the turnable body (1), wherein a jet hole (11), having a second diameter approximately equal to the diameter of the supply pipe (4), extends through the turnable body (1) in a direction approximately perpendicular to the spray-supply hole (10) and intersects the spray-supply hole.

2. A nozzle according to claim 1, wherein the turnable body (1) is in the shape of a ball.

3. A nozzle according to claim 1, wherein the turnable body (1) is in the shape of a cylinder.

4. A nozzle according to claim 1, wherein jet shaping orifice (9) is approximately cylindrical in shape.

5. A nozzle according to claim 1, wherein jet shaping orifice (9) is slot-shaped.

6. A nozzle according to claim 1 wherein on the outside of the nozzle body (2) there is provided a handle (5) which via shaft (6) is attached to the turnable body for the turning thereof.

* * * * *